US009394675B2

(12) United States Patent
Sawaski et al.

(10) Patent No.: US 9,394,675 B2
(45) **Date of Patent: *Jul. 19, 2016**

(54) CAPACITIVE SENSING SYSTEM AND METHOD FOR OPERATING A FAUCET

(71) Applicant: Delta Faucet Company, Indianapolis, IN (US)

(72) Inventors: Joel D Sawaski, Indianapolis, IN (US); Michael J Veros, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 31 days.

This patent is subject to a terminal disclaimer.

(21) Appl. No.: 14/330,991

(22) Filed: Jul. 14, 2014

(65) Prior Publication Data

US 2014/0326321 A1 Nov. 6, 2014

Related U.S. Application Data

(63) Continuation of application No. 13/642,462, filed as application No. PCT/US2011/033241 on Apr. 20, 2011, now Pat. No. 8,776,817, which is a continuation-in-part of application No. 12/763,690, filed on Apr. 20, 2010, now Pat. No. 8,561,626.

(51) Int. Cl.
*E03C 1/05* (2006.01)

(52) U.S. Cl.
CPC ..... *E03C 1/057* (2013.01); *E03C 1/055* (2013.01); *Y10T 137/0318* (2015.04); *Y10T 137/1842* (2015.04); *Y10T 137/8158* (2015.04); *Y10T 137/86389* (2015.04); *Y10T 137/9464* (2015.04)

(58) Field of Classification Search
CPC .... E03C 1/057; E03C 1/055; Y10T 137/9464
USPC ..... 137/801; 251/129.04; 4/623
See application file for complete search history.

(56) References Cited

U.S. PATENT DOCUMENTS

| | | | |
|---|---|---|---|
| 2,991,481 | A | 7/1961 | Book |
| 3,081,594 | A | 3/1963 | Atkins et al. |
| 3,151,340 | A | 10/1964 | Teshima |
| 3,254,313 | A | 5/1966 | Atkins et al. |
| 3,314,081 | A | 4/1967 | Atkins et al. |
| 3,333,160 | A | 7/1967 | Gorski |
| 3,406,941 | A | 10/1968 | Ichimori et al. |

(Continued)

FOREIGN PATENT DOCUMENTS

| | | | |
|---|---|---|---|
| CA | 2492226 | A1 | 7/2005 |
| CN | 1666169 | A | 9/2005 |

(Continued)

OTHER PUBLICATIONS

Camacho et al., Freescale Semiconductor, "Touch Panel System Using MC34940/MC33794 E-Field Sensors," Feb. 2006, 52 pgs.

(Continued)

*Primary Examiner* — Kevin Lee
(74) *Attorney, Agent, or Firm* — Faegre Baker Daniels LLP

(57) ABSTRACT

An electronic faucet comprises a spout having a passageway configured to conduct fluid flow through the spout, an electrically operable valve coupled to the passageway, and a single capacitive sensor coupled to a portion of the faucet. The single capacitive sensor provides both a touch sensor and a proximity sensor for the electronic faucet.

20 Claims, 6 Drawing Sheets

(56) References Cited

U.S. PATENT DOCUMENTS 3,588,038 A 6/1971 Tanaka
3,651,989 A 3/1972 Westrich
3,685,541 A 8/1972 Braucksick et al.
3,705,574 A 12/1972 Duncan
3,765,455 A 10/1973 Countryman
3,799,171 A 3/1974 Patel
3,987,819 A 10/1976 Scheuermann
4,185,336 A 1/1980 Young
4,201,518 A 5/1980 Stevenson
4,290,052 A 9/1981 Eichelberger et al.
4,295,132 A 10/1981 Burney et al.
4,331,292 A 5/1982 Zimmer
4,337,388 A 6/1982 July
4,359,186 A 11/1982 Kiendl
4,406,313 A 9/1983 Bennett et al.
4,407,444 A 10/1983 Knebel et al.
4,409,694 A 10/1983 Barrett et al.
4,410,791 A 10/1983 Eastep
4,420,811 A 12/1983 Tarnay et al.
4,421,269 A 12/1983 Ts'ao
4,424,767 A 1/1984 Wicke et al.
4,429,422 A 2/1984 Wareham
4,436,983 A 3/1984 Solobay
4,439,669 A 3/1984 Ryffel
4,450,829 A 5/1984 Morita et al.
4,459,465 A 7/1984 Knight
4,503,575 A 3/1985 Knoop et al.
4,537,348 A 8/1985 Gossi
4,541,562 A 9/1985 Zukausky
4,554,688 A 11/1985 Puccerella
4,563,780 A 1/1986 Pollack
4,567,350 A 1/1986 Todd, Jr.
4,581,707 A 4/1986 Millar
4,584,463 A 4/1986 Klages et al.
4,604,515 A 8/1986 Davidson
4,606,325 A 8/1986 Lujan
4,611,757 A 9/1986 Saether
4,628,902 A 12/1986 Comber
4,638,147 A 1/1987 Dytch et al.
4,674,678 A 6/1987 Knebel et al.
4,680,446 A 7/1987 Post
4,682,581 A 7/1987 Laing et al.
4,682,728 A 7/1987 Oudenhoven et al.
4,688,277 A 8/1987 Kakinoki et al.
4,700,884 A 10/1987 Barrett et al.
4,700,885 A 10/1987 Knebel
4,709,728 A 12/1987 Ying-Chung
4,713,525 A 12/1987 Eastep
4,716,605 A 1/1988 Shepherd et al.
4,735,357 A 4/1988 Gregory et al.
4,738,280 A 4/1988 Oberholtzer
4,742,456 A 5/1988 Kamena
4,750,472 A 6/1988 Fazekas
4,753,265 A 6/1988 Barrett et al.
4,756,030 A 7/1988 Juliver
4,757,943 A 7/1988 Sperling et al.
4,761,839 A 8/1988 Ganaway
4,762,273 A 8/1988 Gregory et al.
4,768,705 A 9/1988 Tsutsui et al.
4,786,782 A 11/1988 Takai et al.
4,798,224 A 1/1989 Haws
4,808,793 A 2/1989 Hurko
4,832,259 A 5/1989 Vandermeyden
4,845,316 A 7/1989 Kaercher
4,854,498 A 8/1989 Stayton
4,869,287 A 9/1989 Pepper et al.
4,869,427 A 9/1989 Kawamoto et al.
4,870,986 A 10/1989 Barrett et al.
4,872,485 A 10/1989 Laverty
4,875,623 A 10/1989 Garris
4,893,653 A 1/1990 Ferrigno
4,896,658 A 1/1990 Yonekubo et al.
4,901,915 A 2/1990 Sakakibara
4,909,435 A 3/1990 Kidouchi et al.
4,914,758 A 4/1990 Shaw
4,916,613 A 4/1990 Lange et al.
4,917,142 A 4/1990 Laing et al.
4,921,211 A 5/1990 Novak et al.
4,923,116 A 5/1990 Homan
4,930,551 A 6/1990 Haws
4,936,289 A 6/1990 Peterson
4,941,608 A 7/1990 Shimizu et al.
4,945,942 A 8/1990 Lund
4,945,943 A 8/1990 Cogger
4,955,535 A 9/1990 Tsutsui et al.
4,965,894 A 10/1990 Baus
4,967,794 A 11/1990 Tsutsui et al.
4,969,598 A 11/1990 Garris
4,970,373 A 11/1990 Lutz et al.
4,971,106 A 11/1990 Tsutsui et al.
4,981,158 A 1/1991 Brondolino et al.
4,985,944 A 1/1991 Shaw
4,995,585 A 2/1991 Gruber et al.
4,998,673 A 3/1991 Pilolla
5,009,572 A 4/1991 Imhoff et al.
5,012,124 A 4/1991 Hollaway
5,020,127 A 5/1991 Eddas et al.
5,033,508 A 7/1991 Laverty
5,033,715 A 7/1991 Chiang
5,040,106 A 8/1991 Maag
5,042,524 A 8/1991 Lund
5,056,712 A 10/1991 Enck
5,057,214 A 10/1991 Morris
5,058,804 A 10/1991 Yonekubo et al.
5,063,955 A 11/1991 Sakakibara
5,073,991 A 12/1991 Marty
5,074,520 A 12/1991 Lee et al.
5,086,526 A 2/1992 Van Marcke
5,092,560 A 3/1992 Chen
5,095,945 A 3/1992 Jensen
5,105,846 A 4/1992 Britt
5,124,934 A 6/1992 Kawamoto et al.
5,125,433 A 6/1992 DeMoss et al.
5,129,034 A 7/1992 Sydenstricker
5,133,089 A 7/1992 Tsutsui et al.
5,139,044 A 8/1992 Otten et al.
5,143,049 A 9/1992 Laing et al.
5,148,824 A 9/1992 Wilson et al.
5,170,361 A 12/1992 Reed
5,170,514 A 12/1992 Weigert
5,170,816 A 12/1992 Schnieders
5,170,944 A 12/1992 Shirai
5,174,495 A 12/1992 Eichholz et al.
5,175,892 A 1/1993 Shaw
5,183,029 A 2/1993 Ranger
5,184,642 A 2/1993 Powell
5,187,816 A 2/1993 Chiou
5,202,666 A 4/1993 Knippscheer
5,205,318 A 4/1993 Massaro et al.
5,206,963 A 5/1993 Wiens
5,217,035 A 6/1993 Van Marcke
5,224,509 A 7/1993 Tanaka et al.
5,224,685 A 7/1993 Chiang et al.
5,243,717 A 9/1993 Yasuo
5,257,341 A 10/1993 Austin et al.
5,261,443 A 11/1993 Walsh
5,262,621 A 11/1993 Hu et al.
5,265,318 A 11/1993 Shero
5,277,219 A 1/1994 Lund
5,281,808 A 1/1994 Kunkel
5,287,570 A 2/1994 Peterson et al.
5,309,940 A 5/1994 Delabie et al.
5,315,719 A 5/1994 Tsutsui et al.
5,322,086 A 6/1994 Sullivan
5,323,803 A 6/1994 Blumenauer
5,325,822 A 7/1994 Fernandez
5,334,819 A 8/1994 Lin
5,341,839 A 8/1994 Kobayashi et al.
5,351,347 A 10/1994 Kunkel
5,351,712 A 10/1994 Houlihan
5,358,177 A 10/1994 Cashmore
5,361,215 A 11/1994 Tompkins et al.
5,362,026 A 11/1994 Kobayashi et al.
5,385,168 A 1/1995 Lund

(56) References Cited

U.S. PATENT DOCUMENTS

| | | | |
|---|---|---|---|
| 5,397,099 | A | 3/1995 | Pilolla |
| 5,400,961 | A | 3/1995 | Tsutsui et al. |
| 5,408,578 | A | 4/1995 | Bolivar |
| 5,419,930 | A | 5/1995 | Schucker |
| 5,429,272 | A | 7/1995 | Luigi |
| 5,437,003 | A | 7/1995 | Blanco |
| 5,438,642 | A | 8/1995 | Posen |
| 5,467,967 | A | 11/1995 | Gillooly |
| 5,479,558 | A | 12/1995 | White et al. |
| 5,482,250 | A | 1/1996 | Kodaira |
| 5,504,306 | A | 4/1996 | Russell et al. |
| 5,504,950 | A | 4/1996 | Natalizia et al. |
| 5,511,579 | A | 4/1996 | Price |
| 5,511,723 | A | 4/1996 | Eki et al. |
| 5,540,555 | A | 7/1996 | Corso et al. |
| 5,549,273 | A | 8/1996 | Aharon |
| 5,550,753 | A | 8/1996 | Tompkins et al. |
| 5,551,637 | A | 9/1996 | Lo |
| 5,555,912 | A | 9/1996 | Saadi et al. |
| 5,564,462 | A | 10/1996 | Storch |
| 5,566,702 | A | 10/1996 | Philipp |
| 5,570,869 | A | 11/1996 | Diaz et al. |
| 5,572,985 | A | 11/1996 | Benham |
| 5,577,660 | A | 11/1996 | Hansen |
| 5,584,316 | A | 12/1996 | Lund |
| 5,586,572 | A | 12/1996 | Lund |
| 5,588,636 | A | 12/1996 | Eichholz et al. |
| 5,595,216 | A | 1/1997 | Pilolla |
| 5,595,342 | A | 1/1997 | McNair et al. |
| 5,603,344 | A | 2/1997 | Hall |
| 5,609,370 | A | 3/1997 | Szabo et al. |
| 5,610,589 | A | 3/1997 | Evans et al. |
| 5,622,203 | A | 4/1997 | Givler et al. |
| 5,623,990 | A | 4/1997 | Pirkle |
| 5,627,375 | A | 5/1997 | Hsieh |
| 5,650,597 | A | 7/1997 | Redmayne |
| 5,651,384 | A | 7/1997 | Rudrich |
| 5,655,749 | A | 8/1997 | Mauerhofer |
| 5,682,032 | A | 10/1997 | Philipp |
| 5,694,653 | A | 12/1997 | Harald |
| 5,729,422 | A | 3/1998 | Henke |
| 5,730,165 | A | 3/1998 | Philipp |
| 5,735,291 | A | 4/1998 | Kaonohi |
| 5,743,511 | A | 4/1998 | Eichholz et al. |
| 5,755,262 | A | 5/1998 | Pilolla |
| 5,758,688 | A | 6/1998 | Hamanaka et al. |
| 5,758,690 | A | 6/1998 | Humpert et al. |
| 5,769,120 | A | 6/1998 | Laverty et al. |
| 5,771,501 | A | 6/1998 | Shaw |
| 5,775,372 | A | 7/1998 | Houlihan |
| 5,784,531 | A | 7/1998 | Mann et al. |
| 5,790,024 | A | 8/1998 | Ripingill et al. |
| 5,812,059 | A | 9/1998 | Shaw et al. |
| 5,813,655 | A | 9/1998 | Pinchott et al. |
| 5,819,366 | A | 10/1998 | Edin |
| 5,829,467 | A | 11/1998 | Spicher |
| 5,829,475 | A | 11/1998 | Acker |
| 5,845,844 | A | 12/1998 | Zosimodis |
| 5,855,356 | A | 1/1999 | Fait |
| 5,857,717 | A | 1/1999 | Caffrey |
| 5,868,311 | A | 2/1999 | Cretu-Petra |
| 5,872,891 | A | 2/1999 | Son |
| 5,893,387 | A | 4/1999 | Paterson et al. |
| 5,915,417 | A | 6/1999 | Diaz et al. |
| 5,918,855 | A | 7/1999 | Hamanaka et al. |
| 5,934,325 | A | 8/1999 | Brattoli et al. |
| 5,941,275 | A | 8/1999 | Laing |
| 5,941,504 | A | 8/1999 | Toma et al. |
| 5,943,713 | A | 8/1999 | Paterson et al. |
| 5,944,221 | A | 8/1999 | Laing et al. |
| 5,961,095 | A | 10/1999 | Schrott |
| 5,963,624 | A | 10/1999 | Pope |
| 5,966,753 | A | 10/1999 | Gauthier et al. |
| 5,973,417 | A | 10/1999 | Goetz et al. |
| 5,979,776 | A | 11/1999 | Williams |
| 5,983,922 | A | 11/1999 | Laing et al. |
| 5,988,593 | A | 11/1999 | Rice |
| 6,000,170 | A | 12/1999 | Davis |
| 6,003,170 | A | 12/1999 | Humpert et al. |
| 6,003,182 | A | 12/1999 | Song |
| 6,006,784 | A | 12/1999 | Tsutsui et al. |
| 6,019,130 | A | 2/2000 | Rump |
| 6,026,844 | A | 2/2000 | Laing et al. |
| 6,029,094 | A | 2/2000 | Diffut |
| 6,032,616 | A | 3/2000 | Jones |
| 6,042,885 | A | 3/2000 | Woollard et al. |
| 6,059,192 | A | 5/2000 | Zosimadis |
| 6,061,499 | A | 5/2000 | Hlebovy |
| 6,075,454 | A | 6/2000 | Yamasaki |
| 6,082,407 | A | 7/2000 | Paterson et al. |
| 6,101,452 | A | 8/2000 | Krall et al. |
| 6,125,482 | A | 10/2000 | Foster |
| 6,132,085 | A | 10/2000 | Bergeron |
| 6,167,845 | B1 | 1/2001 | Decker, Sr. |
| 6,175,689 | B1 | 1/2001 | Blanco, Jr. |
| 6,182,683 | B1 | 2/2001 | Sisk |
| 6,192,192 | B1 | 2/2001 | Illy et al. |
| 6,195,588 | B1 | 2/2001 | Gauthier et al. |
| 6,202,980 | B1 | 3/2001 | Vincent et al. |
| 6,220,297 | B1 | 4/2001 | Marty et al. |
| 6,227,235 | B1 | 5/2001 | Laing et al. |
| 6,240,250 | B1 | 5/2001 | Blanco, Jr. |
| 6,250,558 | B1 | 6/2001 | Dogre Cuevas |
| 6,250,601 | B1 | 6/2001 | Kolar et al. |
| 6,273,394 | B1 | 8/2001 | Vincent et al. |
| 6,283,139 | B1 | 9/2001 | Symonds et al. |
| 6,286,764 | B1 | 9/2001 | Garvey et al. |
| 6,288,707 | B1 | 9/2001 | Philipp |
| 6,290,139 | B1 | 9/2001 | Kolze |
| 6,294,786 | B1 | 9/2001 | Marcichow et al. |
| 6,315,208 | B1 | 11/2001 | Doyle |
| 6,317,717 | B1 | 11/2001 | Lindsey et al. |
| 6,321,785 | B1 | 11/2001 | Bergmann |
| 6,337,635 | B1 | 1/2002 | Ericksen et al. |
| 6,340,032 | B1 | 1/2002 | Zosimadis |
| 6,341,389 | B2 | 1/2002 | Philipps-Liebich et al. |
| 6,351,603 | B2 | 2/2002 | Waithe et al. |
| 6,363,549 | B2 | 4/2002 | Humpert |
| 6,373,265 | B1 | 4/2002 | Morimoto et al. |
| 6,377,009 | B1 | 4/2002 | Philipp |
| 6,381,770 | B1 | 5/2002 | Raisch |
| 6,389,226 | B1 | 5/2002 | Neale et al. |
| 6,438,770 | B1 | 8/2002 | Hed et al. |
| 6,445,306 | B1 | 9/2002 | Trovato et al. |
| 6,446,875 | B1 | 9/2002 | Brooks et al. |
| 6,452,514 | B1 | 9/2002 | Philipp |
| 6,457,355 | B1 | 10/2002 | Philipp |
| 6,466,036 | B1 | 10/2002 | Philipp |
| 6,473,917 | B1 | 11/2002 | Mateina |
| 6,474,951 | B2 | 11/2002 | Stephan et al. |
| 6,513,787 | B1 | 2/2003 | Jeromson et al. |
| 6,522,078 | B1 | 2/2003 | Okamoto et al. |
| 6,535,134 | B2 | 3/2003 | Lang et al. |
| 6,535,200 | B2 | 3/2003 | Philipp |
| 6,536,464 | B1 | 3/2003 | Lum et al. |
| 6,549,816 | B2 | 4/2003 | Gauthier et al. |
| 6,574,426 | B1 | 6/2003 | Blanco, Jr. |
| 6,588,377 | B1 | 7/2003 | Leary et al. |
| 6,588,453 | B2 | 7/2003 | Marty et al. |
| 6,612,267 | B1 | 9/2003 | West |
| 6,619,320 | B2 | 9/2003 | Parsons |
| 6,622,930 | B2 | 9/2003 | Laing et al. |
| 6,629,645 | B2 | 10/2003 | Mountford et al. |
| 6,639,209 | B1 | 10/2003 | Patterson et al. |
| 6,644,333 | B2 | 11/2003 | Gloodt |
| 6,659,048 | B1 | 12/2003 | DeSantis et al. |
| 6,676,024 | B1 | 1/2004 | McNerney et al. |
| 6,684,822 | B1 | 2/2004 | Lieggi |
| 6,691,338 | B2 | 2/2004 | Zieger |
| 6,705,534 | B1 | 3/2004 | Mueller |
| 6,707,030 | B1 | 3/2004 | Watson |
| 6,734,685 | B2 | 5/2004 | Rudrich |
| 6,738,996 | B1 | 5/2004 | Malek et al. |
| 6,757,921 | B2 | 7/2004 | Esche |

(56) References Cited

U.S. PATENT DOCUMENTS

| | | | |
|---|---|---|---|
| 6,768,103 | B2 | 7/2004 | Watson |
| 6,770,869 | B2 | 8/2004 | Patterson et al. |
| 6,779,552 | B1 | 8/2004 | Coffman |
| 6,838,887 | B2 | 1/2005 | Denen et al. |
| 6,845,526 | B2 | 1/2005 | Malek et al. |
| 6,877,172 | B2 | 4/2005 | Malek et al. |
| 6,892,952 | B2 | 5/2005 | Chang et al. |
| 6,895,985 | B2 | 5/2005 | Popper et al. |
| 6,913,203 | B2 | 7/2005 | DeLangis |
| 6,955,333 | B2 | 10/2005 | Patterson et al. |
| 6,956,498 | B1 | 10/2005 | Gauthier et al. |
| 6,962,162 | B2 | 11/2005 | Acker |
| 6,962,168 | B2 | 11/2005 | McDaniel et al. |
| 6,964,404 | B2 | 11/2005 | Patterson et al. |
| 6,964,405 | B2 | 11/2005 | Marcichow et al. |
| 6,968,860 | B1 | 11/2005 | Haenlein et al. |
| 6,993,607 | B2 | 1/2006 | Philipp |
| 6,995,670 | B2 | 2/2006 | Wadlow et al. |
| 6,998,545 | B2 | 2/2006 | Harkcom et al. |
| 7,006,078 | B2 | 2/2006 | Kim |
| 7,014,166 | B1 | 3/2006 | Wang |
| 7,015,704 | B1 | 3/2006 | Lang |
| 7,025,077 | B2 | 4/2006 | Vogel |
| 7,030,860 | B1 | 4/2006 | Hsu et al. |
| 7,069,357 | B2 | 6/2006 | Marx et al. |
| 7,069,941 | B2 | 7/2006 | Parsons et al. |
| 7,083,156 | B2 | 8/2006 | Jost et al. |
| 7,096,517 | B2 | 8/2006 | Gubeli et al. |
| 7,099,649 | B2 | 8/2006 | Patterson et al. |
| 7,102,366 | B2 | 9/2006 | Denen et al. |
| 7,107,631 | B2 | 9/2006 | Lang et al. |
| 7,150,293 | B2 | 12/2006 | Jonte |
| 7,174,577 | B2 | 2/2007 | Jost et al. |
| 7,174,579 | B1 | 2/2007 | Bauza |
| 7,228,874 | B2 | 6/2007 | Bolderbeij |
| 7,232,111 | B2 | 6/2007 | McDaniels et al. |
| 7,278,624 | B2 | 10/2007 | Iott et al. |
| 7,307,485 | B1 | 12/2007 | Snyder et al. |
| 7,537,023 | B2 | 5/2009 | Marty et al. |
| 7,537,195 | B2 | 5/2009 | McDaniels et al. |
| 7,690,395 | B2 | 4/2010 | Jonte et al. |
| 7,766,026 | B2 | 8/2010 | Boey |
| 7,784,481 | B2 | 8/2010 | Kunkel |
| 8,528,579 | B2 | 9/2013 | Jonte et al. |
| 8,561,626 | B2 | 10/2013 | Sawaski et al. |
| 8,776,817 | B2 * | 7/2014 | Sawaski et al. ..... 251/129.04 |
| 2001/0011389 | A1 | 8/2001 | Philipps-Liebich et al. |
| 2001/0011390 | A1 | 8/2001 | Humpert et al. |
| 2001/0011558 | A1 | 8/2001 | Schumacher |
| 2001/0011560 | A1 | 8/2001 | Pawelzik et al. |
| 2001/0022352 | A1 | 9/2001 | Rudrich |
| 2002/0007510 | A1 | 1/2002 | Mann |
| 2002/0015024 | A1 | 2/2002 | Westerman et al. |
| 2002/0113134 | A1 | 8/2002 | Laing et al. |
| 2002/0117122 | A1 | 8/2002 | Lindner |
| 2002/0148040 | A1 | 10/2002 | Mateina |
| 2002/0175789 | A1 | 11/2002 | Pimouguet |
| 2002/0179723 | A1 | 12/2002 | Wack et al. |
| 2003/0041374 | A1 | 3/2003 | Franke |
| 2003/0080194 | A1 | 5/2003 | O'Hara et al. |
| 2003/0088338 | A1 | 5/2003 | Phillips et al. |
| 2003/0089399 | A1 | 5/2003 | Acker |
| 2003/0125842 | A1 | 7/2003 | Chang et al. |
| 2003/0126993 | A1 | 7/2003 | Lassota et al. |
| 2003/0185548 | A1 | 10/2003 | Novotny et al. |
| 2003/0201018 | A1 | 10/2003 | Bush |
| 2003/0213062 | A1 | 11/2003 | Honda et al. |
| 2003/0234769 | A1 | 12/2003 | Cross et al. |
| 2004/0011399 | A1 | 1/2004 | Segien, Jr. |
| 2004/0041033 | A1 | 3/2004 | Kemp |
| 2004/0041034 | A1 | 3/2004 | Kemp |
| 2004/0041110 | A1 | 3/2004 | Kaneko |
| 2004/0061685 | A1 | 4/2004 | Ostergard et al. |
| 2004/0088786 | A1 | 5/2004 | Malek et al. |
| 2004/0135010 | A1 | 7/2004 | Malek et al. |
| 2004/0143898 | A1 | 7/2004 | Jost et al. |
| 2004/0144866 | A1 | 7/2004 | Nelson et al. |
| 2004/0149643 | A1 | 8/2004 | Vandenbelt et al. |
| 2004/0155116 | A1 | 8/2004 | Wack et al. |
| 2004/0206405 | A1 | 10/2004 | Smith et al. |
| 2004/0212599 | A1 | 10/2004 | Cok et al. |
| 2004/0262552 | A1 | 12/2004 | Lowe |
| 2005/0001046 | A1 | 1/2005 | Laing |
| 2005/0006402 | A1 | 1/2005 | Acker |
| 2005/0022871 | A1 | 2/2005 | Acker |
| 2005/0044625 | A1 | 3/2005 | Kommers |
| 2005/0086958 | A1 | 4/2005 | Walsh |
| 2005/0117912 | A1 | 6/2005 | Patterson et al. |
| 2005/0121529 | A1 | 6/2005 | DeLangis |
| 2005/0125083 | A1 | 6/2005 | Kiko |
| 2005/0127313 | A1 | 6/2005 | Watson |
| 2005/0146513 | A1 | 7/2005 | Hill et al. |
| 2005/0150552 | A1 | 7/2005 | Forshey |
| 2005/0150556 | A1 | 7/2005 | Jonte |
| 2005/0150557 | A1 | 7/2005 | McDaniel et al. |
| 2005/0151101 | A1 | 7/2005 | McDaniel et al. |
| 2005/0194399 | A1 | 9/2005 | Proctor |
| 2005/0199841 | A1 | 9/2005 | O'Maley |
| 2005/0199843 | A1 | 9/2005 | Jost et al. |
| 2005/0205818 | A1 | 9/2005 | Bayley et al. |
| 2005/0253102 | A1 | 11/2005 | Boilen et al. |
| 2005/0273218 | A1 | 12/2005 | Breed et al. |
| 2006/0066991 | A1 | 3/2006 | Hirano et al. |
| 2006/0101575 | A1 | 5/2006 | Louis |
| 2006/0130907 | A1 | 6/2006 | Marty et al. |
| 2006/0130908 | A1 | 6/2006 | Marty et al. |
| 2006/0138246 | A1 | 6/2006 | Stowe et al. |
| 2006/0145111 | A1 | 7/2006 | Lang et al. |
| 2006/0153165 | A1 | 7/2006 | Beachy |
| 2006/0186215 | A1 | 8/2006 | Logan |
| 2006/0200903 | A1 | 9/2006 | Rodenbeck et al. |
| 2006/0201558 | A1 | 9/2006 | Marty et al. |
| 2006/0202142 | A1 | 9/2006 | Marty et al. |
| 2006/0207019 | A1 | 9/2006 | Vincent |
| 2006/0212016 | A1 | 9/2006 | Lavon et al. |
| 2006/0214016 | A1 | 9/2006 | Erdely et al. |
| 2006/0231638 | A1 | 10/2006 | Belz et al. |
| 2010/0170570 | A1 * | 7/2010 | Rodenbeck et al. ..... 251/129.04 |
| 2014/0261780 | A1 * | 9/2014 | Thomas et al. ..... 137/801 |

FOREIGN PATENT DOCUMENTS

| | | | |
|---|---|---|---|
| CN | 101563561 | A | 10/2009 |
| DE | 3339849 | | 5/1985 |
| DE | 04401637 | | 5/1998 |
| DE | 19815324 | | 11/2000 |
| EP | 0961067 | B1 | 12/1999 |
| EP | 1 134 895 | | 9/2001 |
| JP | 63-111383 | | 5/1998 |
| JP | 2000-73426 | | 3/2000 |
| JP | 2003-20703 | A | 1/2003 |
| JP | 2003-105817 | | 4/2003 |
| JP | 2003-293411 | | 10/2003 |
| JP | 2004-92023 | | 3/2004 |
| JP | 2005-146551 | A | 6/2005 |
| KR | 10-1997-0700266 | | 1/1997 |
| KR | 2003-0077823 | | 10/2003 |
| KR | 20-0382786 | Y1 | 4/2005 |
| WO | WO 91/17377 | | 11/1991 |
| WO | WO 96/14477 | | 5/1996 |
| WO | WO 01/20204 | | 3/2001 |
| WO | WO 03/098421 | | 11/2003 |
| WO | WO 2004/094990 | | 11/2004 |
| WO | WO 2005/057086 | | 6/2005 |
| WO | WO 2006/098795 | | 9/2006 |
| WO | WO 2006/136256 | | 12/2006 |
| WO | WO 2007/059051 | | 5/2007 |
| WO | WO 2007/124311 | | 11/2007 |
| WO | WO 2007/124438 | | 11/2007 |
| WO | WO 2008/088534 | | 7/2008 |
| WO | WO 2008/094247 | | 8/2008 |
| WO | WO 2008/094651 | | 8/2008 |

(56) References Cited

FOREIGN PATENT DOCUMENTS

| | | |
|---|---|---|
| WO | WO 2008/118402 | 10/2008 |
| WO | WO 2009/075858 | 6/2009 |
| WO | WO 2011/133665 | 10/2011 |

OTHER PUBLICATIONS

Dallmer Manutronic brochure, "The First Electronic mixer-taps that your hands can orchestrate," Dallmer Handel GmbH, at least as early as Jan. 31, 2008, 12 pgs.
Hego WaterDesign, "Touch Faucets—Amazing Futuristic Faucet Designs," Oct. 6, 2009, 3 pgs.
KWC AG, Kitchen Faucet 802285 Installation and Service Instructions, dated Jul. 2005, 8 pgs.
Philipp, "Tough Touch Screen," applicanceDESIGN, Feb. 2006, 4 pgs.
Quantum Research Group, "E401 User Manual," at least as early as Jun. 2011, 15 pgs.
Quantum Research Group, "Gorenje Puts QSlideTM Technology into Next-Generation Kitchen Hob," Feb. 8, 2006, http://www.qprox.com/news/gorenje.php, 3 pgs.
Quantum Research Group, "Qprox™ Capacitive Touch Applications," http://www.qprox.com/background/applications.php, copyright 2005, 8 pgs.
Quantum Research Group, "QT401 QSlide™ Touch Slider IC," 2004, 16 pgs.
Quantum Research Group, "QT411-ISSG QSlide™ Touch Slider IC," 2004-2005, 12 pgs.
Sequine et al., Cypress Perform, "Application Notes AN2233a," Apr. 14, 2005, 6 pgs.
Sequine et al., Cypress Perform, "Application Notes AN2292," Oct. 31, 2005, 15 pgs.
SLOAN® Optima® i.q. Electronic Hand Washing Faucet, Apr. 2004, 2 pgs.
Symmons, Ultra-Sense, Battery-Powered Faucets with PDS and Ultra-Sense AC Powered Faucets, © 1999-2004, 2 pgs.
Symmons, Ultra-Sense, Sensor Faucet with Position-Sensitive Detection, © 2001-2002, 2 pgs.
Symmons® Commercial Faucets: Reliability With a Sense of Style, at least as early as Jun. 2011, 1 pg.
Symmons®, "Ultra-Sense® Battery-Powered, Sensor-Operated Lavatory Faucet S-6080 Series," Oct. 2002, 4 pgs.
Symmons®, "Ultra-Sense® Sensor Faucets with Position-Sensitive Detection," Aug. 2004, 4 pgs.
Technical Concepts International, Inc., Capri AutoFaucet® with Surround Sensor™ Technology, 500556, 500576, 500577, at least as early as Jun. 2011, 1 pg.
Technical Concepts, AutoFaucet® with "Surround Sensor" Technology, Oct. 2005, 4 pgs.
TOTO® Products, "Self-Generating EcoPower System Sensor Faucet, Standard Spout," Specification Sheet, Nov. 2002, 2 pgs.
Various Products (available at least before Apr. 20, 2006), 5 pgs.
Villeroy & Boch "Magic Faucet," at least as early as Jun. 2011, 2 pgs.
Villeroy & Boch web pages, "Magic Basin," 2 pgs., downloaded from http://www.villeroy-boch.com on Dec. 27, 2006.
Watermark XX-AUT, XX-AUT-2, Installation Instructions, "Proximity Faucet with Capacitive Detection", Jan. 2010, 8 pgs.
ZURN® Plumbing Products Group, "AquaSense® Sensor Faucet," Jun. 9, 2004, 2 pgs.
ZURN® Plumbing Products Group, "AquaSense® Z6903 Series", Installation, Operation, Maintenance and Parts Manual, Aug. 2001, 5 pgs.

* cited by examiner

CAPACITIVE SENSING SYSTEM AND METHOD FOR OPERATING A FAUCET

CROSS REFERENCE TO RELATED APPLICATIONS

This application is a continuation of U.S. application Ser. No. 13/642,462, filed on Oct. 19, 2012, now U.S. Pat. No. 8,776,817, the disclosure of which are expressly incorporated by reference herein. U.S. application Ser. No. 13/642,462 is a U.S. National Phase Application of PCT International Application No. PCT/US2011/033241, filed on Apr. 20, 2011 and a continuation-in-part of U.S. application Ser. No. 12/763,690, filed on Apr. 20, 2010, now U.S. Pat. No. 8,561,626, the disclosures of which are expressly incorporated by reference herein.

BACKGROUND AND SUMMARY OF THE INVENTION

The present invention relates generally to electronic faucets. More particularly, the present invention relates to capacitive sensing systems and methods for operating a faucet.

Electronic faucets are often used to control fluid flow. Some electronic faucets include proximity sensors such as active infrared ("IR") proximity detectors or capacitive proximity sensors to control operation of the faucet. Such proximity sensors are used to detect a user's hands positioned near the faucet and automatically start fluid flow through the faucet in response to detection of the user's hands. Other electronic faucets use touch sensors to control the faucet. Such touch sensors may include capacitive touch sensors or other types of touch sensors located on a spout or on a handle of the faucet for controlling operation of the faucet. Electronic faucets may also include separate touch and proximity sensors.

The present invention uses a single capacitive sensor to provide both touch and hands free modes of operation of the faucet. A user can selectively activate the hands free mode of operation so that the capacitive sensor senses a user's hands in a detection area located near the faucet without requiring the user to touch the faucet. When the hands free mode is activated, the single capacitive sensor detects a user's hands in the detection area and automatically starts fluid flow. The hands free mode may also be selectively disabled.

The use of the capacitive sensor for both touch and proximity sensing eliminates the need for an IR detector and its associated IR detection window. In illustrated embodiments, use of both touch and hands free activation of an electronic faucet provides variable control of water flow for various tasks such as hand-washing, filling a sink, running hot water to purge cold water from the line, or the like. In an illustrated embodiment, both touch and hands free detection is performed with capacitive sensing circuitry connected to the spout with a single wire. A controller of the electronic faucet is programmed with software to evaluate the output signal from the capacitive sensor to determine whether user's hands are detected in the detection area when the proximity sensor is active and to indicate which portion of the faucet is touched and for how long in order to operate the faucet as discussed below.

In an illustrated embodiment of the present disclosure, an electronic faucet comprises a spout having a passageway configured to conduct fluid flow through the spout, an electrically operable valve coupled to the passageway, and a single capacitive sensor coupled to a portion of the faucet.

The single capacitive sensor provides both a touch sensor and a proximity sensor for the electronic faucet.

In an illustrated embodiment, the capacitive sensor includes an electrode coupled to the spout. Also in an illustrated embodiment, the electronic faucet further comprises a controller coupled to the capacitive sensor. The controller being configured to monitor an output signal from the capacitive sensor to detect when a portion of the faucet is touched by a user and to detect when a user's hands are located in a detection area located near the spout. The controller is illustratively configured to operate the faucet in either a first mode of operation in which the proximity sensor is inactive or a second mode of operation in which the proximity sensor is active.

In another illustrated embodiment of the present disclosure, a method is provided for controlling fluid flow in an electronic faucet having a spout, a passageway configured to conduct fluid flow through the spout, an electrically operable valve coupled to the passageway, a manual valve located in series with the electrically operable valve, and a manual handle configured to control the manual valve. The illustrated method comprises providing a single capacitive sensor coupled to a portion of the faucet, monitoring an output signal from the capacitive sensor to detect when a user touches at least one of the spout and the manual valve handle and to detect when a user's hands are located in a detection area located near the faucet, and controlling the electrically operable valve is response to the monitoring step.

In an illustrated embodiment, the method further includes providing a first mode of operation of the faucet in which the proximity sensor is inactive, providing a second mode of operation of the faucet in which the proximity sensor is active, and selectively changing between the first and second modes of operation. In one illustrated embodiment, the step of selectively changing between the first and second modes of operation comprises toggling the faucet between the first mode of operation and the second mode of operation in response to detecting a predetermined pattern of touching at least one of the spout and the manual valve handle. In another illustrated embodiment, the step of selectively changing between the first and second modes of operation comprises actuating a mode selector switch.

Additional features and advantages of the present invention will become apparent to those skilled in the art upon consideration of the following detailed description of an illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
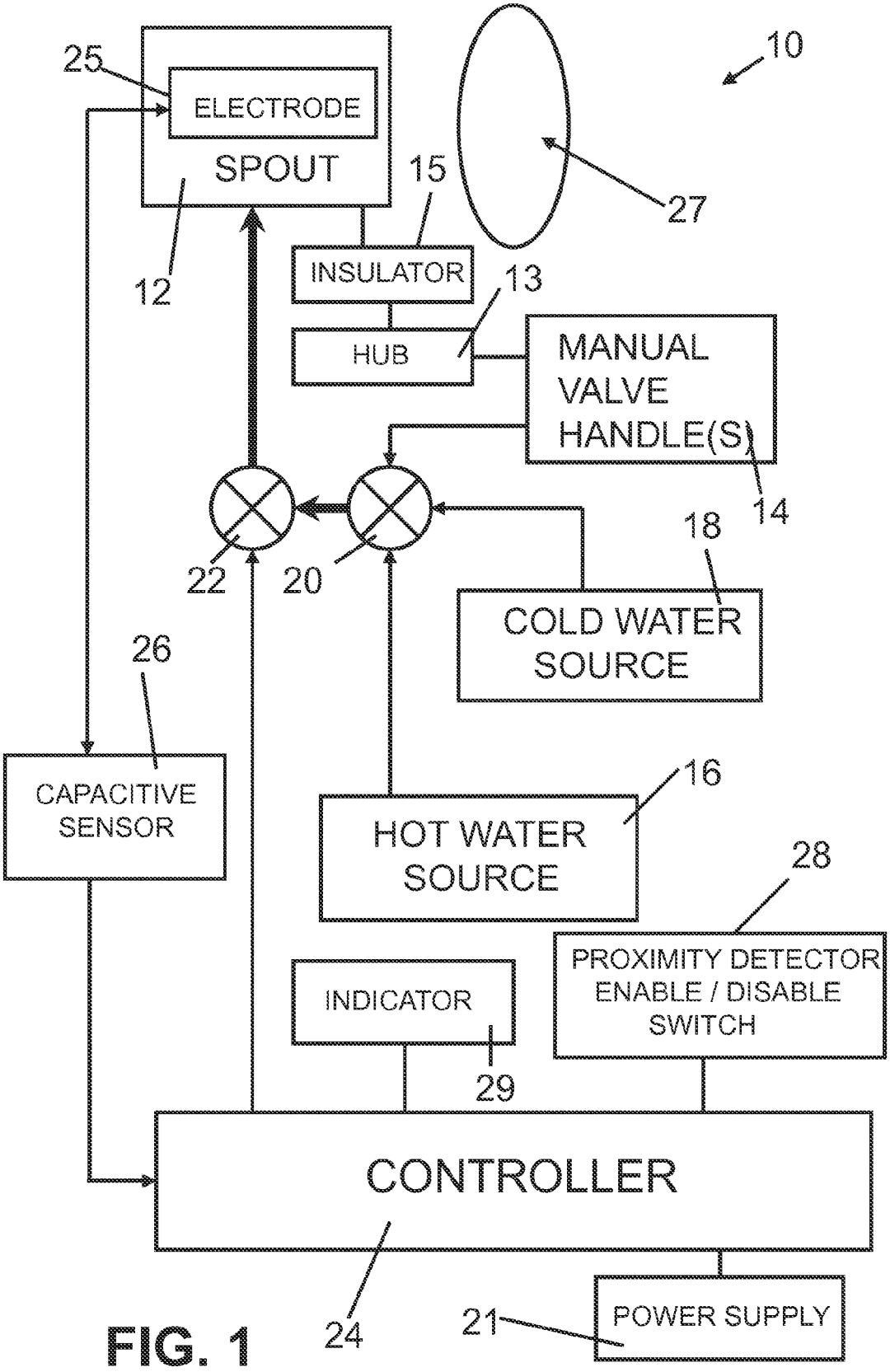
FIG. 1 is a block diagram of an illustrated embodiment of an electronic faucet.

For the purposes of promoting an understanding of the principles of the present disclosure, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates.

FIG. 1 is a block diagram illustrating one embodiment of an electronic faucet system 10 of an illustrated embodiment of the present disclosure. The system 10 includes a spout 12 for delivering fluids such as water and at least one manual valve handle 14 for controlling the flow of fluid through the spout 12 in a manual mode. A hot water source 16 and cold water source 18 are coupled to a valve body assembly 20. In one illustrated embodiment, separate manual valve handles 14 are provided for the hot and cold water sources 16, 18. In other embodiments, such as a kitchen embodiment, a single manual valve handle 14 is used for both hot and cold water delivery. In such kitchen embodiment, the manual valve handle 14 and spout 12 are typically coupled to a basin through a single hole mount. An output of valve body assembly 20 is coupled to an actuator driven valve 22 which is controlled electronically by input signals received from a controller 24. In an illustrative embodiment, actuator driven valve 22 is a solenoid valve such as a magnetically latching pilot-controlled solenoid valve, for example.

In an alternative embodiment, the hot water source 16 and cold water source 18 may be connected directly to actuator driven valve 22 to provide a fully automatic faucet without any manual controls. In yet another embodiment, the controller 24 controls an electronic proportioning valve (not shown) to supply fluid to the spout 12 from hot and cold water sources 16, 18.

Because the actuator driven valve 22 is controlled electronically by controller 24, flow of water can be controlled using an output from a capacitive sensor 26. As shown in FIG. 1, when the actuator driven valve 22 is open, the faucet system 10 may be operated in a conventional manner, i.e., in a manual control mode through operation of the handle(s) 14 and the manual valve member of valve body assembly 20. Conversely, when the manually controlled valve body assembly 20 is set to select a water temperature and flow rate, the actuator driven valve 22 can be touch controlled using a touch sensor, or activated by a proximity sensor when an object (such as a user's hands) are within a detection zone or area 27 to toggle water flow on and off.

The output signal from capacitive sensor 26 may be used to control actuator driven valve 22 which thereby controls flow of water to the spout 12 from the hot and cold water sources 16 and 18. By sensing capacitance changes with capacitive sensor 26, the controller 24 can make logical decisions to control different modes of operation of system 10 such as changing between a manual mode of operation and a hands free mode of operation as described in U.S. Pat. No. 7,537,023; U.S. application Ser. No. 11/641,574; U.S. Pat. No. 7,150,293; U.S. application Ser. No. 11/325,128; and PCT International Application Ser. Nos. PCT/US2008/01288 and PCT/US2008/013598, the disclosures of which are all expressly incorporated herein by reference.

The amount of fluid from hot water source 16 and cold water source 18 is determined based on one or more user inputs, such as desired fluid temperature, desired fluid flow rate, desired fluid volume, various task based inputs, various recognized presentments, and/or combinations thereof. As discussed above, the system 10 may also include electronically controlled mixing valve which is in fluid communication with both hot water source 16 and cold water source 18. Exemplary electronically controlled mixing valves are described in U.S. Pat. No. 7,458,520 and PCT International Application Ser. No. PCT/US2007/060512, the disclosures of which are expressly incorporated by reference herein.

The controller 24 is coupled to a power supply 21 which may be a building power supply and/or to a battery power supply. In an illustrated embodiment, an electrode 25 of capacitive sensor 26 is coupled to the spout 12. In an exemplary embodiment, the capacitive sensor 26 may be a CapSense capacitive sensor available from Cypress Semiconductor Corporation or other suitable capacitive sensor. An output from capacitive sensor 26 is coupled to controller 24. As discussed above, the capacitive sensor 26 and electrode 25 are used for both a touch sensor and a hands free proximity sensor. In the hands free mode of operation, capacitive sensor 26 and controller 24 detect a user's hands or other object within the detection area 27 located near the spout 12.

An operator of the electronic faucet 10 can selectively enable or disable the proximity detector using a mode selector switch 28 coupled to the controller 24. The faucet 10 may include an indicator 29 to provide a visual or audio indication when the electronic faucet is in the hands free mode. The hands free mode can also be enabled or disabled using a series of touches of the spout 12 and/or handle 14. In an illustrated embodiment, the spout 12 is coupled to faucet body hub 13 through an insulator 15. The faucet body hub 13 may be electrically coupled to the manual valve handle 14. Therefore, the spout 12 is electrically isolated from the faucet body hub 13 and the handle 14. In this illustrated embodiment, the electrode 25 is directly coupled to the spout 12 and capacitively coupled to the handle 14 so that the capacitive sensor 26 and controller 24 may determine whether the spout 12 or the manual valve handle 14 is touched by a user based on the difference in the capacitive sensor level as illustrated, for example, in PCT International Publication No. WO2008/088534, the disclosure of which is incorporated herein by reference.

Figure 2:
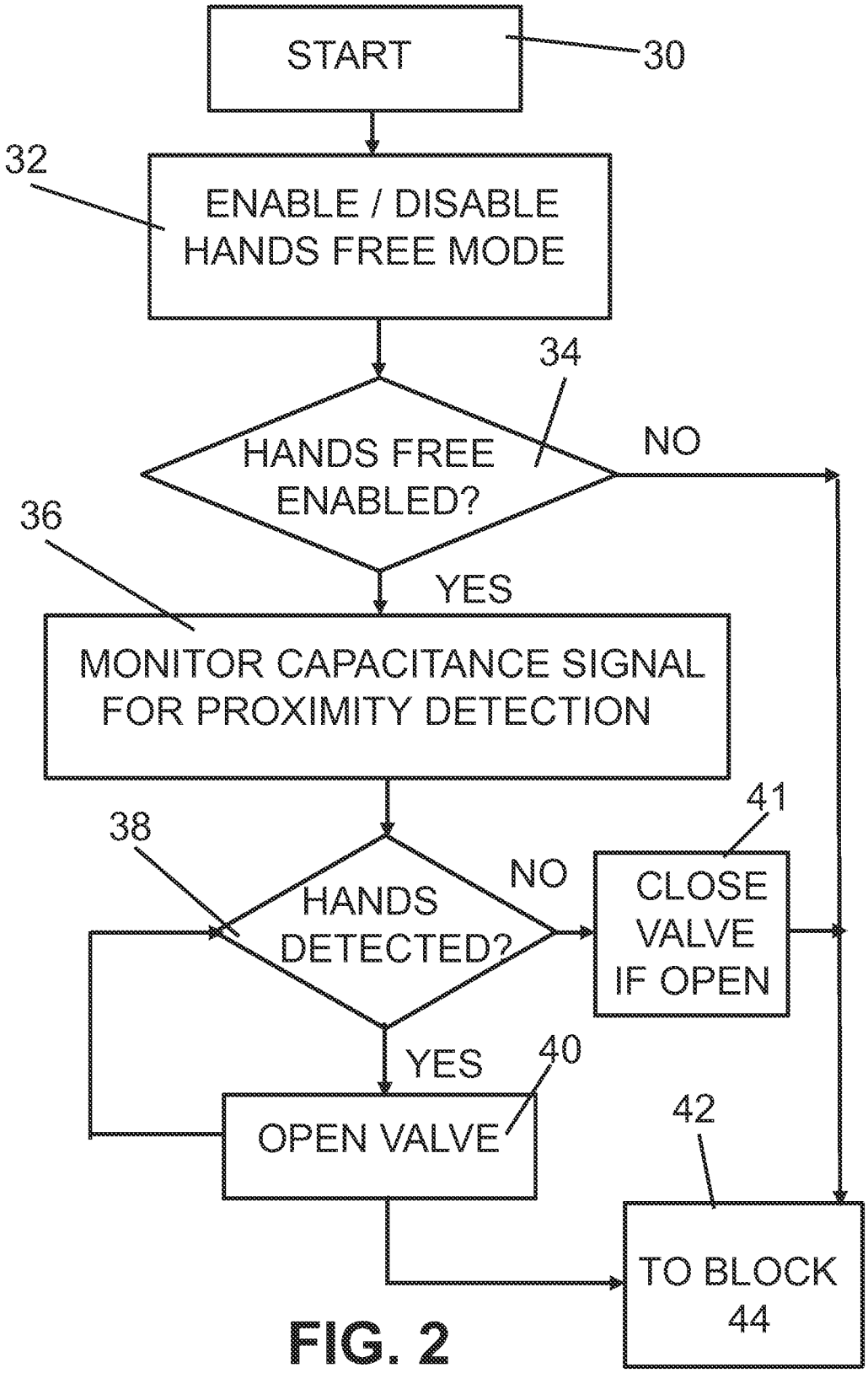
FIGS. 2 and 3 are flowcharts illustrating operation of a capacitive sensing system and method using a single capacitive sensor for both touch and proximity detection.
Figure 3:
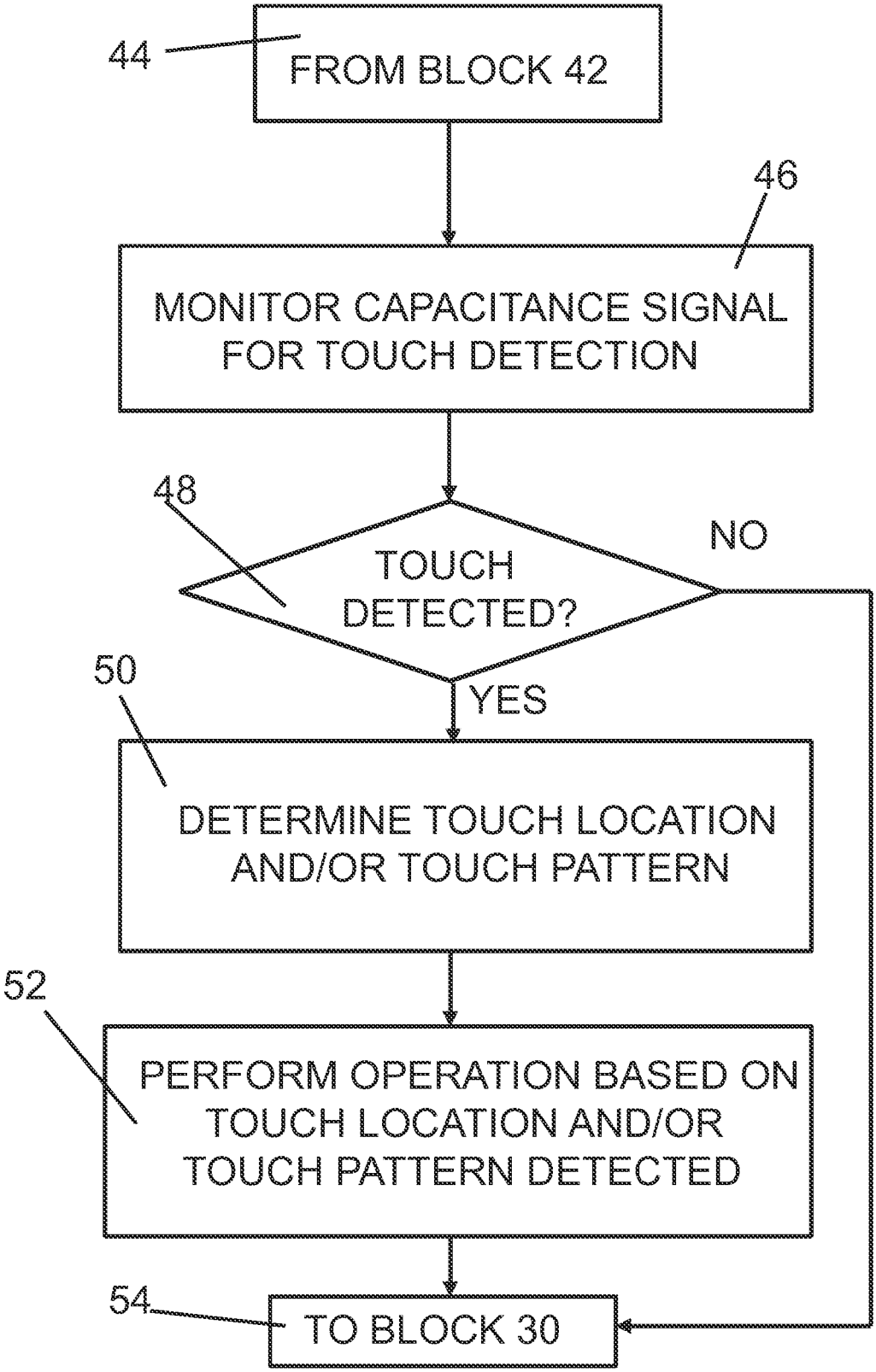
Figure 4:
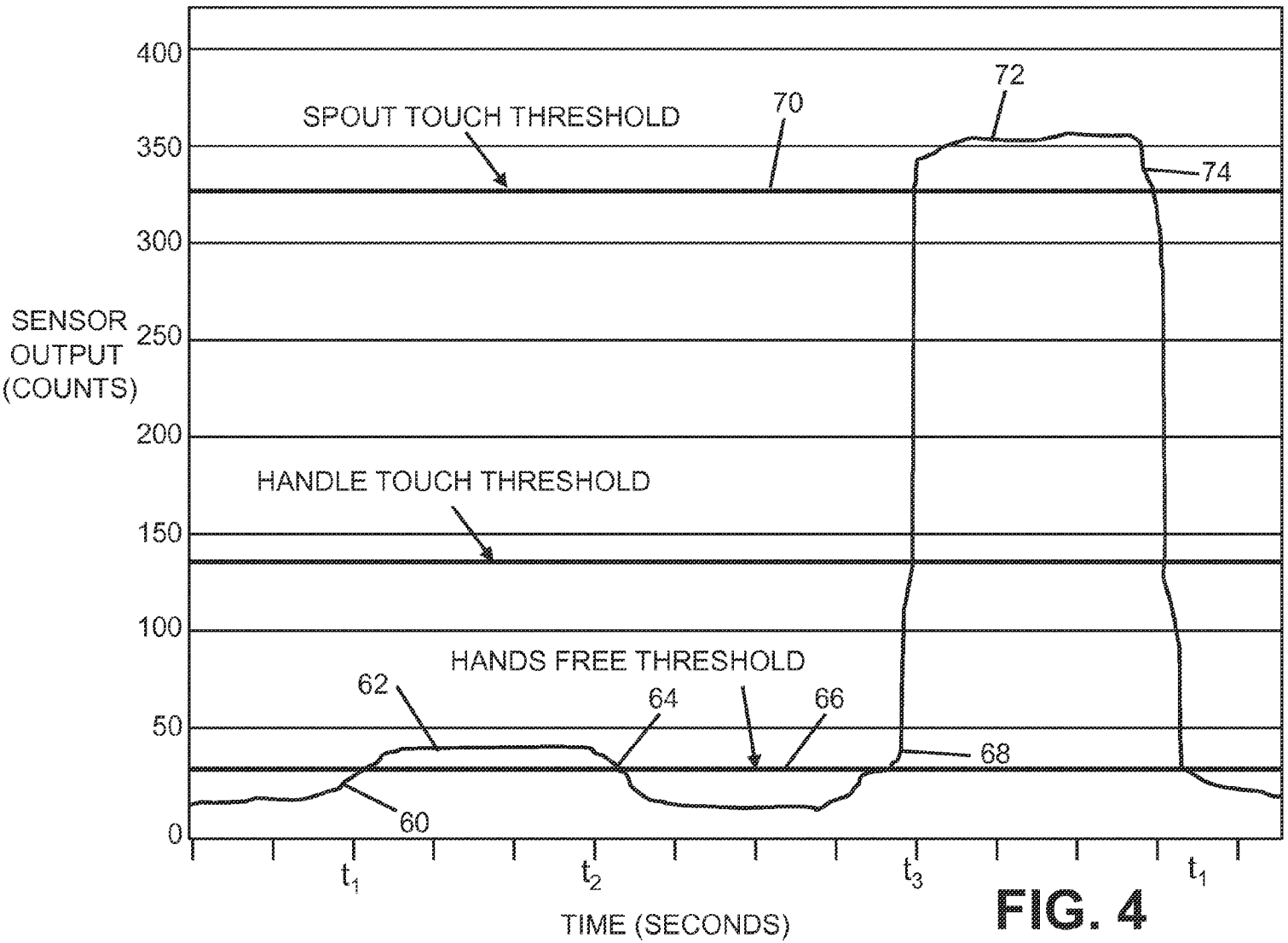
FIGS. 4 and 5 illustrate an exemplary capacitive signal output in response to a user's hands located within a detection zone, a user touching a spout of the electronic faucet, and a user touching a handle of the electronic faucet.

In an illustrated embodiment of the present disclosure, a system and method are disclosed for providing both touch and proximity detection for an electronic faucet with a single capacitive sensor as illustrated in FIGS. 2-4. Controller 24 operates as shown in FIGS. 2 and 3 to control the electronic faucet 10.

Operation begins at block 30. Controller 24 selectively enables or disables the hands free mode as illustrated at block 32. As discussed above, using the mode selector switch 28 coupled to controller 24 selectively enabled and disabled the hands free mode. Alternatively, the user may enable or disable the hands free mode of operation by using a predetermined pattern of touching the spout and/or manual valve handle 14. For example, the hands free function can be turned off by grasping a spout 12 and touching the handle 14 twice quickly in one embodiment. The hands free mode can be turned back on by repeating this touching pattern. It is understood that other touching patterns may be used to turn the hands free mode of operation on and off as well.

Controller 24 determines whether or not the hands free function is enabled at block 34. If the hands free function is enabled, the controller monitors the capacitance signal for proximity detection as illustrated at block 36. In other words, controller 24 monitors an output from capacitive sensor 26 to determine whether a user's hands are within the detection area 27. Controller 24 determines whether the user's hands are detected in the detection area 27 at block 38. If so, controller 24 sends a signal to open valve 22 and provide fluid flow through the spout 12 as illustrated at block 40. Controller 24 then advances to block 44 as illustrated at block 42, while continuing to monitor the hands free detection area at block 38. If the user's hands are not detected within the detection zone at block 38, controller 24 closes the valve 22, if it was open as illustrated at block 41, and advances to block 44 of FIG. 3 as illustrated at block 42.

If the hands free mode of operation is disabled at block 34, controller advances to block 44 of FIG. 3 directly as illustrated at block 42. Beginning at block 44 in FIG. 3, the controller 24 monitors the capacitance signal from capacitive sensor 26 for touch detection as illustrated at block 46. Controller 24 determines whether a touch (tap or grab) is detected on either the spout 12 or the handle 14, if applicable, at block 48. If no touch is detected, controller 24 returns to block 30 of FIG. 2 as illustrated at block 54 to continue the monitoring process. If a touch is detected at block 48, controller 24 determines the touch location and/or touch pattern at block 50.

The controller 24 processes the output capacitive signal received from capacitive sensor 26 to determine whether the spout 12 or handle 14 was touched based on the signal characteristics. Next, controller 24 performs an operation based on the touch location and/or touch pattern detected as illustrated at block 52 and described in detail with reference to FIG. 6. Depending upon the length of time that the spout and/or handle 14 is touched (tap or grab) and the pattern of touching, different functions can be implemented. By providing two sensing methods, both touch detection and proximity detection, with a single capacitive sensor, the present disclosure reduces component count and costs associated with providing the sensing mechanism. A second sensor is not needed to provide both touch and proximity sensing.

The user can place the electronic faucet 10 in the hands free mode so that the user does not have to touch the spout or handle to activate the faucet. In the hands free mode of operation, capacitive sensor 26 detects the user's hands in detection area 27 and controller 24 actuates valve 22 to provide fluid flow until the user's hands leave the detection area 27. For other tasks, such as filling the sink, purging cold water from the hot water line or other function, different touch sequences can be used. The touch duration and patterns can control flow rate, water temperature, activate and deactivate features such as the hands free on and off, or set other program features.

In one illustrated embodiment, the capacitive sensor 26 is a CapSense capacitive sensor available from Cypress Semiconductor Corporation as discussed above. In this illustrated embodiment, the capacitive sensor 26 converts capacitance into a count value. The unprocessed count value is referred to as a raw count. Processing the raw count signal determines whether the spout 12 is touched or whether a user's hands are in the detection area 27. Preferably, a signal to noise ratio of at least 3:1 is used.

FIG. 4 shows an exemplary output signal from capacitive sensor 26. Controller 24 establishes a hands free threshold level 66 and a spout touch threshold level 70 as illustrated in FIG. 4. As the user's hands enter the detection zone 27, a slope of the capacitive signal changes gradually as illustrated at location 60 in FIG. 4. Edge portion 60 of the capacitive signal illustrates the effect of the user's hands within the detection area 27 and the negative slope of capacitive signal at location 64 illustrates the user's hands leaving the detection area 27. When a change in slope is detected at edge location 60 and the capacitive signal rises above the hands free threshold 66 such as during portion 62 of the signal, the controller 24 determines that the user's hands are within the detection area 27. If the hands free mode is active or enabled, controller 24 will then provide a signal to valve 22 to provide fluid flow through the spout 12. Illustratively, a controller 24 maintains the fluid flow for a slight delay time (illustratively about 2 seconds) after the capacitive signal drops below the threshold level at location 64. This reduces the likelihood of pulsation if the user's hands are moved slightly or for a very short duration out of the detection area 27 and then back into the detection area 27.

The same output signal from the single capacitive sensor 26 may also be used to determine whether the spout 12 or a handle 14 is touched. When the electrode 25 is coupled to the spout 12 and the spout 12 is touched, a large positive slope is generated in the capacitive signal as illustrated at location 68. The capacitive signal count level exceeds the touch threshold 70 during the time of the touch which is shown by portion 72 of the capacitive signal. Controller 24 may then detect a negative slope at location 74 indicating that the touch has ended. The controller 24 may distinguish between a "tap" and a "grab" of the spout 12 based on the amount of time between the positive and negative slopes of the capacitive signal.

In an illustrated embodiment, hands free threshold 66 for proximity detection is set at about 30-40 counts. The spout touch detection threshold 70 is illustratively set at about 300-400 counts. In other words, the amplitude of the capacitive signal from capacitive sensor 26 for the spout touch threshold 70 is about 10 times greater than the amplitude for the hands free threshold 66.

Figure 5:
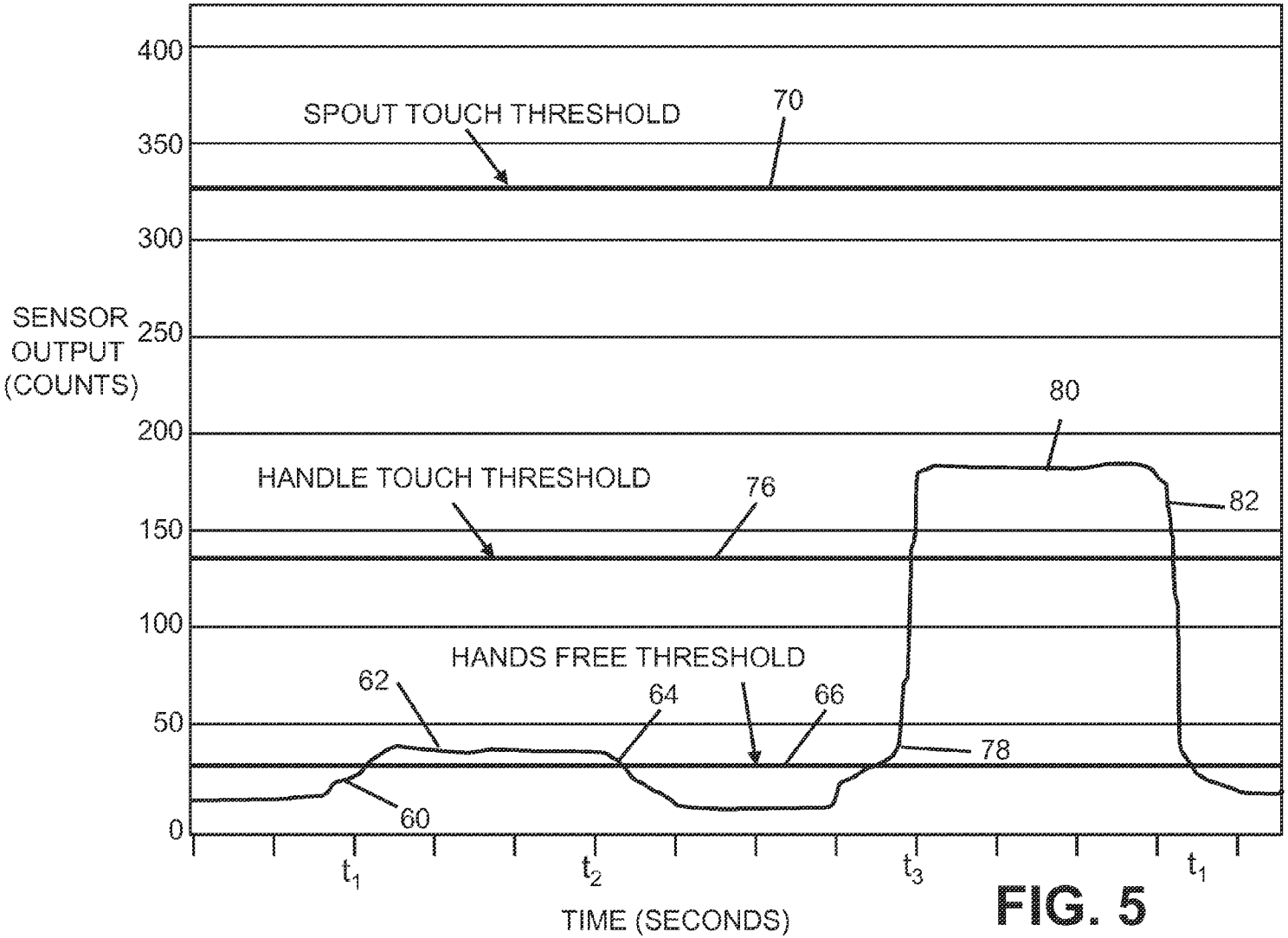

If the capacitive sensor 26 and electrode 25 are also used to detect touching of the handle 14, another threshold level is provided for the handle touch. For example, the handle touch threshold may be set at a level 76 shown in FIGS. 4 and 5. FIG. 5 illustrates the capacitive signal when the handle 14 is touched by a user. A large positive slope is detected at location 78 and the output signal crosses the handle touch threshold 76 at signal portion 80, but the capacitive sensor output signal does not reach the spout touch threshold 70. A negative slope at location 82 indicates that the touch of the handle 14 has ended. The handle touch threshold 76 is illustratively set at about 130-150 counts. The count values described herein are for illustrative purposes only and may vary depending upon the application. Illustratively, the handle touch threshold 76 is about 35-45% of the spout touch threshold 70, and the hands free threshold 66 is about 5-10% of the spout touch threshold 70.

The present disclosure relates to a single capacitive sensor in an electronic faucet which operates in either a "touch mode" or a "proximity mode". In the touch mode of operation, operation of the faucet changes when a user touches the spout or handle of the faucet. In a proximity or "hands-free" mode of operation, operation of the faucet begins automatically the person's hands are placed in a detection area near a portion of the faucet. The user may select to disable the proximity mode of operation and only use the touch mode. The single capacitive sensor is connected to the faucet with a single wire to provide an inexpensive way to provide both touch and proximity sensing without adding a second sensor to the faucet.

Figure 6:
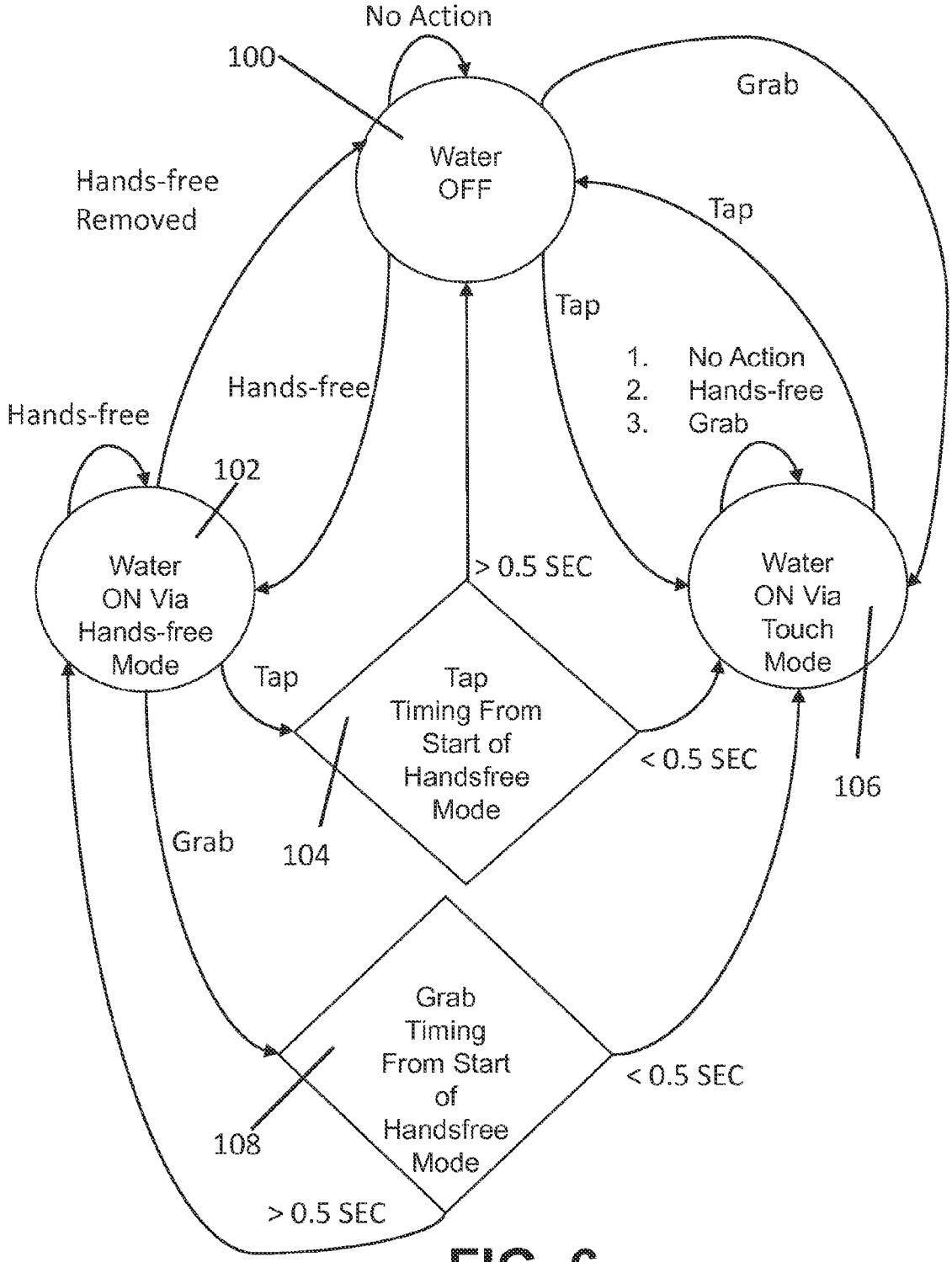
FIG. 6 is a state diagram illustrating operation of the faucet when both the touch detection and proximity detection modes are active.

FIG. 6 is a state diagram illustrating operation of the faucet 10 when both the touch mode and proximity (hands-free) mode of operation are active. When the water is off as illustrated at location 100, the controller 24 monitors both the single capacitive sensor 26 for proximity and touch detection as discussed above. If controller 24 detects the user's hands in the detection area 27, controller 24 turns the water on via the hands-free mode as illustrated at location 102. If the user's hands are subsequently removed from detection area 27, the water is turned off. When the water has been turned on via the hands-free mode at location 102, the water remains on as long as the user's hands are still detected in the detection area 27.

If controller 24 detects a tap on the spout after detecting user's hands in the detection area 27 and turning the water on at location 102, controller 24 then determines the tap timing from the start of hands-free mode as illustrated at block 104. If the tap is detected less than 0.5 seconds after the hands-free mode turned on the water after the user's hands were detected, the controller 24 leaves the water on via the touch mode as illustrated at block 106. In other words, if the user's hands reach through the detection area 27 in order to tap the spout, a hands-free detection is made within the detection area 27 followed within 0.5 seconds by a tap of the spout indicating that the controller 24 should turn the water on via the touch mode at location 106. If the tap occurs at block 104 at a time greater than 0.5 seconds after the hands-free mode of operation was detected, controller 24 turns the water off at block 100.

When the water is on via the hands-free mode at block 102 and the controller 24 detects a grab of the spout, the controller 24 determines a grab timing from the start of the hands-free mode as illustrated at block 108. If the grab is detected at a time greater than 0.5 seconds after the hands free mode was initiated, the water remains on via the hands-free mode at location 102. However, if the grab of the spout occurs at a time less than 0.5 seconds after the initiation of the hands-free mode, the water remains on via the touch mode at location 106. The 0.5 second timing may be set to another predetermined time, if desired.

When the water is off at location 100 and either a tap or a grab of the spout 12 is detected, water is turned on via the touch mode at location 106. Water remains on via the touch mode as long as no action occurs, the user's hands are detected in the detection area 27, or a spout grab is detected. If a tap of the spout when the water is on via the touch mode at location 106, the water is turned off In one illustrated embodiment of the present disclosure, the faucet 10 turns off the water differently depending on how it was turned on as discussed above. If the faucet 10 is turned on by touching (tapping or grabbing) a portion of the faucet 10, then the faucet 10 is turned off by either a tap or by a one minute timeout. If the faucet 10 is turned on in the hands-free mode by detecting a user's hands in detection area 27, the faucet 10 is turned off when the user's hands are removed from the detection area 27, by a tap of the faucet 10 by the user more than 0.5 second after the hands-free mode is detected, or by the one minute timeout. Therefore, if a user intended to turn the faucet on using the hands-free mode, but accidentally and unknowingly touched the faucet 10 less than 0.5 second after the hands-free mode was detected, then the faucet 10 will not turn off when the user's hands leave the detection area 27. This may cause the user to believe that the faucet 10 is not functioning properly to turn off the water in the hands-free mode.

In order to address this issue, the indicator 29 is a light such as an LED in one illustrated embodiment of the present disclosure. The controller 24 illuminates the indicator light 29 in a distinguishing pattern to provide a visual indication when the faucet is operating in the hands-free mode of operation. For example, when the faucet 10 is activated by a detected touch, the controller 24 turns on the indicator light 29 continuously. When the faucet 10 is turned on due to hands-free activation, the controller 24 turns the indicator light 29 on and off in a blinking pattern. Therefore, the user can determine the mode of operation of the faucet 10 based on the pattern of light from the indicator 29. It is understood that other types of indicators 29 may be used to distinguish between the hands-free and touch modes of operation.

While this disclosure has been described as having exemplary designs and embodiments, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains. Therefore, although the invention has been described in detail with reference to certain illustrated embodiments, variations and modifications exist within the spirit and scope of the invention as described and defined in the following claims.

The invention claimed is:

1. An electronic faucet comprising:

a spout having a passageway configured to conduct fluid flow through the spout;

an electrically operable valve coupled to the passageway; and a single capacitive sensor coupled to a portion of the faucet, the single capacitive sensor providing both a touch sensor and a proximity sensor for the electronic faucet.

2. The faucet of claim 1, wherein the capacitive sensor includes an electrode coupled to the spout.

3. The faucet of claim 1, further comprising a controller coupled to the capacitive sensor, the controller being configured to monitor an output signal from the capacitive sensor to detect when a portion of the faucet is touched by a user and to detect when a user's hands are located in a detection area located near the spout.

4. The faucet of claim 3, wherein the controller is configured to operate the faucet in one of a first mode of operation in which the proximity sensor is inactive and a second mode of operation in which the proximity sensor is active.

5. The faucet of claim 4, wherein the controller toggles the faucet between the first mode of operation and the second mode of operation in response to a predetermined pattern of touching of the faucet.

6. A method of controlling fluid flow in an electronic faucet having a spout, a passageway configured to conduct fluid flow through the spout, an electrically operable valve coupled to the passageway, a manual valve located in series with the electrically operable valve, and a manual handle configured to control the manual valve, the method comprising:

providing a single capacitive sensor coupled to a portion of the faucet;

monitoring an output signal from the capacitive sensor to detect when a user touches at least one of the spout and the manual valve handle and to detect when a user's hands are located in a detection area located near the faucet; and controlling the electrically operable valve is response to the step of monitoring the output signal.

7. The method of claim 6, further comprising:

providing a first mode of operation of the faucet in which the proximity sensor is inactive;

providing a second mode of operation of the faucet in which the proximity sensor is active; and selectively changing between the first and second modes of operation.

8. The method of claim 7, wherein the step of selectively changing between the first and second modes of operation comprises toggling the faucet between the first mode of operation and the second mode of operation in response to detecting a predetermined pattern of touching at least one of the spout and the manual valve handle.

9. The method of claim 6, wherein the monitoring step includes distinguishing between a user tapping one of the spout and the manual valve handle, a user grabbing the spout, and a user grabbing the manual valve handle.

10. The method of claim 6, further comprising toggling the electronic valve between open and closed positions in response to detecting a user touching one of the spout and the manual valve handle during the monitoring step.

11. The method of claim 6, wherein the capacitive sensor includes an electrode coupled to one of the spout and the manual valve handle.

12. The method of claim 11, wherein the electrode is coupled to the spout, and wherein the manual valve handle is at least partially formed from a conductive material, and further comprising an insulator located between the spout and the manual valve handle to capacitively couple the conductive manual valve handle to the electrode.

13. The method of claim 11, wherein the electrode is coupled to one of the spout and the manual valve handle by a single wire.

14. The method of claim 7, further comprising toggling the electrically operable valve from a closed position to an open position in response to detecting a user's hands in the detection area when the faucet is in the second mode of operation.

15. The method of claim 14, further comprising toggling the electrically operable valve from the open position to the closed position in response to detecting that the user's hands have been removed from the detection area.

16. The method of claim 15, further comprising delaying toggling the electrically operable valve from the open position to the closed position for a predetermined time after detecting that the user's hands have been removed from the detection area, and maintaining the valve in the open position if the user's hands are subsequently detected in the detection area within the predetermined time.

17. The method of claim 6, wherein the monitoring step includes distinguishing between a user tapping the spout and a user grabbing the spout, and wherein the controlling step includes starting fluid flow through the spout in response to detecting a user's hands in the detection area via a hands-free mode of operation, maintaining fluid flow via a touch mode if a tap of the spout is detected within a time period less than a predetermined time after the hands-free mode is initiated, and shutting off fluid flow through the spout if a tap of the spout is detected at a time greater than the predetermined time after initiation of the hands-free mode.

18. The method of claim 17, wherein the controlling step further comprises maintaining fluid flow through the spout via the touch mode if a grab of the spout is detected within a time period less than the predetermined time after initiation of the hands-free mode, and maintaining fluid flow via the hands-free mode if a grab of the spout is detected at a time greater than the predetermined time after initiation of the hands-free mode.

19. The method of claim 6, wherein the monitoring step includes distinguishing between the user tapping a spout and a user grabbing a spout, and wherein the controlling step includes starting fluid flow through the spout in a touch mode of operation in response to detecting either of a tap or a grab of the spout, maintaining fluid flow through the spout in the touch mode in response to detecting the user's hands in the detection area or in response to a grab of the spout, and shutting off fluid flow through the spout in response to detecting a subsequent tap of the spout.

20. The method of claim 6, wherein the controlling step includes starting fluid flow through the spout in response to detecting a user's hands in the detection area via a hands-free mode of operation and starting fluid flow through the spout in a touch mode of operation in response to detecting either of a tap or a grab of the spout, and wherein the method further includes actuating an indicator in first and second distinguishable patterns to provide an indication whether the faucet is operating in the hands-free mode of operation or the touch mode of operation.

* * * * *